US009138108B2

(12) United States Patent
Pixley

(10) Patent No.: US 9,138,108 B2
(45) Date of Patent: Sep. 22, 2015

(54) BAR SOAP HOLDER HAVING SELF-CLEANING CHARACTERISTICS

(76) Inventor: Henry D. Pixley, East Syracuse, NY (US)

( * ) Notice: Subject to any disclaimer, the term of this patent is extended or adjusted under 35 U.S.C. 154(b) by 0 days.

(21) Appl. No.: 13/303,742

(22) Filed: Nov. 23, 2011

(65) Prior Publication Data

US 2013/0043360 A1 Feb. 21, 2013

Related U.S. Application Data

(60) Provisional application No. 61/524,032, filed on Aug. 16, 2011.

(51) Int. Cl.
*A47K 5/02* (2006.01)
*A47K 5/03* (2006.01)

(52) U.S. Cl.
CPC .... *A47K 5/02* (2013.01); *A47K 5/03* (2013.01)

(58) Field of Classification Search
CPC ..... A47K 5/02; A47K 5/03; A47K 5/04; A47K 5/05; A47K 5/18; B67C 11/02
USPC ..... 248/309.1, 346.04, 346.06, 176.1; 224/926, 544; 206/77.1; 132/290; 220/501, 503, 505, 555, 676, 661, 635, 220/628; 141/331
See application file for complete search history.

(56) References Cited

U.S. PATENT DOCUMENTS 279,739 A * 6/1883 Gifford ..... 141/299
1,404,730 A * 1/1922 Bandy ..... 312/351
1,889,501 A * 11/1932 Schnake ..... 248/441.1
2,036,204 A * 4/1936 Enssle ..... 206/77.1
2,283,875 A * 5/1942 Mathias ..... 248/212
2,390,874 A * 12/1945 Endebrock ..... 248/213.2
2,704,907 A * 3/1955 Durkee ..... 206/77.1

(Continued)

FOREIGN PATENT DOCUMENTS

CN 201798656 U 4/2011
JP 02019294 A 1/1990

(Continued)

OTHER PUBLICATIONS

Korean Intellectual Property Office, International Search Report and Written Opinion for Corresponding International Application No. PCT/US2012/030695, dated Jul. 2, 2012 (9 pgs).

(Continued)

*Primary Examiner* — Terrell McKinnon
*Assistant Examiner* — Michael McDuffie
(74) *Attorney, Agent, or Firm* — Harris Beach PLLC

(57) ABSTRACT

A bar soap holder is provided that includes a support base to allow dislodgement of a soap bar without substantial movement of the bar soap holder. The bar soap holder further includes a holder body coupled to the support base. The holder body defines an upper central opening dimensioned for receiving the soap bar. The soap holder body includes a first support surface and an opposing second support surface disposed within an interior region of the soap holder body for supporting the soap bar. The first and the second support surfaces are positioned at a tapered incline angle greater than 25° relative to a horizontal plane. The holder body further defines a drain path from the first and second support surfaces to the reservoir. The bar soap holder further includes a reservoir for collection of soap water that is coupled to the support surfaces by the drain path.

5 Claims, 8 Drawing Sheets

(56) References Cited

U.S. PATENT DOCUMENTS

| | | | | |
|---|---|---|---|---|
| 2,891,348 | A * | 6/1959 | Blagg | 248/309.3 |
| 2,938,297 | A * | 5/1960 | Greene | 248/205.5 |
| 3,164,356 | A * | 1/1965 | Zajaczkowski | 248/684 |
| 3,177,048 | A * | 4/1965 | Whatley | 312/351 |
| 3,185,537 | A * | 5/1965 | Wright | 312/351 |
| D250,076 | S | 10/1978 | Aust | |
| 4,248,361 | A * | 2/1981 | Moyle | 222/179.5 |
| 4,271,878 | A * | 6/1981 | Bologa | 141/375 |
| 4,277,042 | A | 7/1981 | Ash, Sr. | |
| 4,527,764 | A * | 7/1985 | Krause | 248/309.1 |
| 4,585,199 | A * | 4/1986 | Chap | 248/682 |
| 4,608,774 | A * | 9/1986 | Sherman | 43/114 |
| D293,638 | S | 1/1988 | Sussman | |
| 4,938,345 | A * | 7/1990 | Bolton | 206/77.1 |
| 4,999,124 | A * | 3/1991 | Copeland | 510/514 |
| 5,156,450 | A * | 10/1992 | Lee | 312/248 |
| 5,253,752 | A * | 10/1993 | Jang | 206/77.1 |
| 5,417,261 | A * | 5/1995 | Kanzler et al. | 141/313 |
| 5,491,870 | A * | 2/1996 | Holmes | 15/301 |
| D402,839 | S | 12/1998 | Bova et al. | |
| D407,252 | S * | 3/1999 | Hampshire | D6/540 |
| 5,947,272 | A * | 9/1999 | Park | 206/77.1 |
| 6,315,153 | B1 * | 11/2001 | Osborn | 220/737 |
| 6,318,422 | B2 * | 11/2001 | Woratyla et al. | 141/333 |
| 6,662,940 | B1 * | 12/2003 | Kowal | 206/77.1 |
| 6,766,544 | B1 * | 7/2004 | Lloyd et al. | 4/559 |
| 7,234,673 | B2 * | 6/2007 | Graneto, III | 248/311.2 |
| 7,328,876 | B2 * | 2/2008 | Jones | 248/311.2 |
| 8,322,525 | B2 * | 12/2012 | Sawalski | 206/207 |
| D681,989 | S * | 5/2013 | Pixley | D6/536 |
| 2004/0074922 | A1 * | 4/2004 | Bothor et al. | 222/105 |
| 2006/0060742 | A1 | 3/2006 | Kumar | |
| 2007/0056862 | A1 * | 3/2007 | Jones | 206/77.1 |
| 2008/0083628 | A1 * | 4/2008 | Sines | 206/77.1 |
| 2008/0221516 | A1 * | 9/2008 | Partika et al. | 604/110 |
| 2009/0283178 | A1 * | 11/2009 | Sun | 141/337 |
| 2011/0023227 | A1 * | 2/2011 | Sines | 4/628 |

FOREIGN PATENT DOCUMENTS

| | | | |
|---|---|---|---|
| JP | 2004008758 | A | 1/2004 |
| KR | 200341034 | | 2/2004 |

OTHER PUBLICATIONS

State Intellectual Property Office, First Office Action for Corresponding Chinese Application No. 201210036261.X dated Mar. 21, 2014 in the Chinese and English languages (16 pgs).

* cited by examiner

BAR SOAP HOLDER HAVING SELF-CLEANING CHARACTERISTICS

CROSS REFERENCE TO RELATED APPLICATION

Reference is made to and this application claims priority from and the benefit of U.S. Provisional Application Ser. No. 61/524,032, filed Aug. 16, 2011, entitled "BAR SOAP HOLDER HAVING SELF-CLEANING CHARACTERISTICS", which application is incorporated herein in its entirety by reference.

FIELD OF THE INVENTION

This disclosure relates generally to a bar soap holder and, more specifically, to a bar soap holder having self-cleaning characteristics.

BACKGROUND OF THE INVENTION

The bar soap holders commonly used today are known as bar soap dishes. These dishes are made of various materials including plastic, metal, stone, synthetic, ceramic and glass, and support the bar soap on a generally flat or concave surface. A long existing problem associated with the bar soap dish is that it collects soap water every time a wet bar soap is placed back into the dish. When the bar soap is left to sit in the soap water, it becomes soft and messy, resulting in much wasted soap and requires time and effort for frequent cleaning of the soap dish.

Some soap dish designs have tried to solve the above mentioned problem by using a wire soap dish design. This involves supporting the bar soap on a wire grid. However, the wires tend to cut into the soft surface of the bar soap, removing soap from the bar, and these wires also require frequent cleaning, due to soap build up on the wire grid.

Other soap dish designs have also tried to solve the above mentioned problem by supporting the bar soap on a plastic or nylon bed of bristles. However, these bristles end up being pushed into the soft surface of the bar soap, removing soap from the bar, and these bristles also require frequent cleaning, due to soap build up on the bristles.

SUMMARY OF THE INVENTION

The novel bar soap holder disclosed herein provides a solution to these and other problems. In one aspect of the invention, a bar soap holder is provided that includes a support base to allow dislodgement of a soap bar without substantial movement of the bar soap holder. The bar soap holder further includes a soap holder body coupled to the support base. The soap holder body defines an upper central opening dimensioned for receiving the soap bar. The soap holder body includes a first support surface and an opposing second support surface disposed within an interior region of the soap holder body for supporting the soap bar. The first support surface and the second support surface are positioned at a tapered incline angle greater than 25° relative to a horizontal plane. The soap holder body further defines a drain path from the first and second support surfaces to the reservoir. The bar soap holder further includes a reservoir for collection of soap water. The reservoir is coupled to the first support surface and the opposing second support surface by the drain path.

In another aspect of the invention, a bar soap holder is provided that includes a reservoir for collection of soap water, a soap holder body coupled to the reservoir, and an attachment element adapted to mount the bar soap holder vertically to a wall. The soap holder body defines an upper central opening dimensioned for receiving a soap bar, and further defines a first access slot extending downwardly from the upper central opening. The first access slot is dimensioned to allow grasping the soap bar to aid in dislodgement. The soap holder body includes a first support surface and an opposing second support surface disposed within an interior region of the soap holder body for supporting the soap bar. The first support surface and the second support surface are positioned at a tapered incline angle greater than 25° relative to a horizontal plane. The soap holder body further defines a drain path from the first support surface to the reservoir.

In another aspect of the invention, a bar soap holder is provided that includes a support base adapted for securement to a countertop and a soap holder body coupled to the support base. The soap holder body defines an upper central opening dimensioned for receiving a soap bar. The soap holder body includes a first support surface and an opposing second support surface disposed within an interior region of the soap holder body for supporting the soap bar. The first support surface and the second support surface are positioned at a tapered incline angle greater than 25° relative to a horizontal plane. The soap holder body further defines a drain path from the first support surface.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Some prior art bar soap holders are ill-designed in that they are lightweight and fall over easily, and the soap bar is allowed to dry and get stuck to the holder between uses. When a user grasps the bar of soap, the soap sticks to the holder and either the holder is knocked over or the holder and soap are lifted up together and must be separated using both hands. Thus, the bar soap holder cannot be used with one hand as intended.

Figure 1:
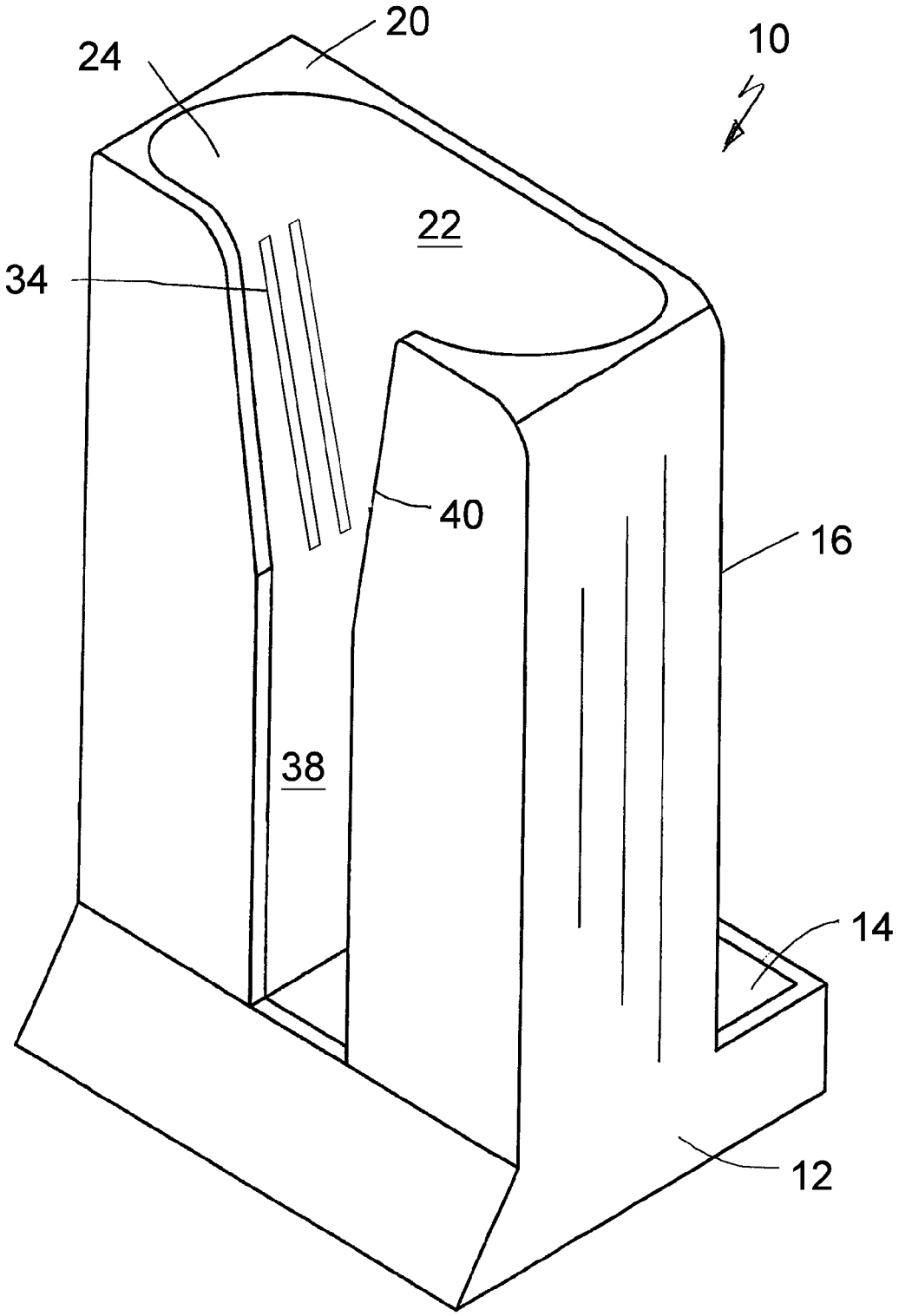
FIG. 1 schematically illustrates a perspective view of a bar soap holder according to one embodiment of the invention.
Figure 2A:
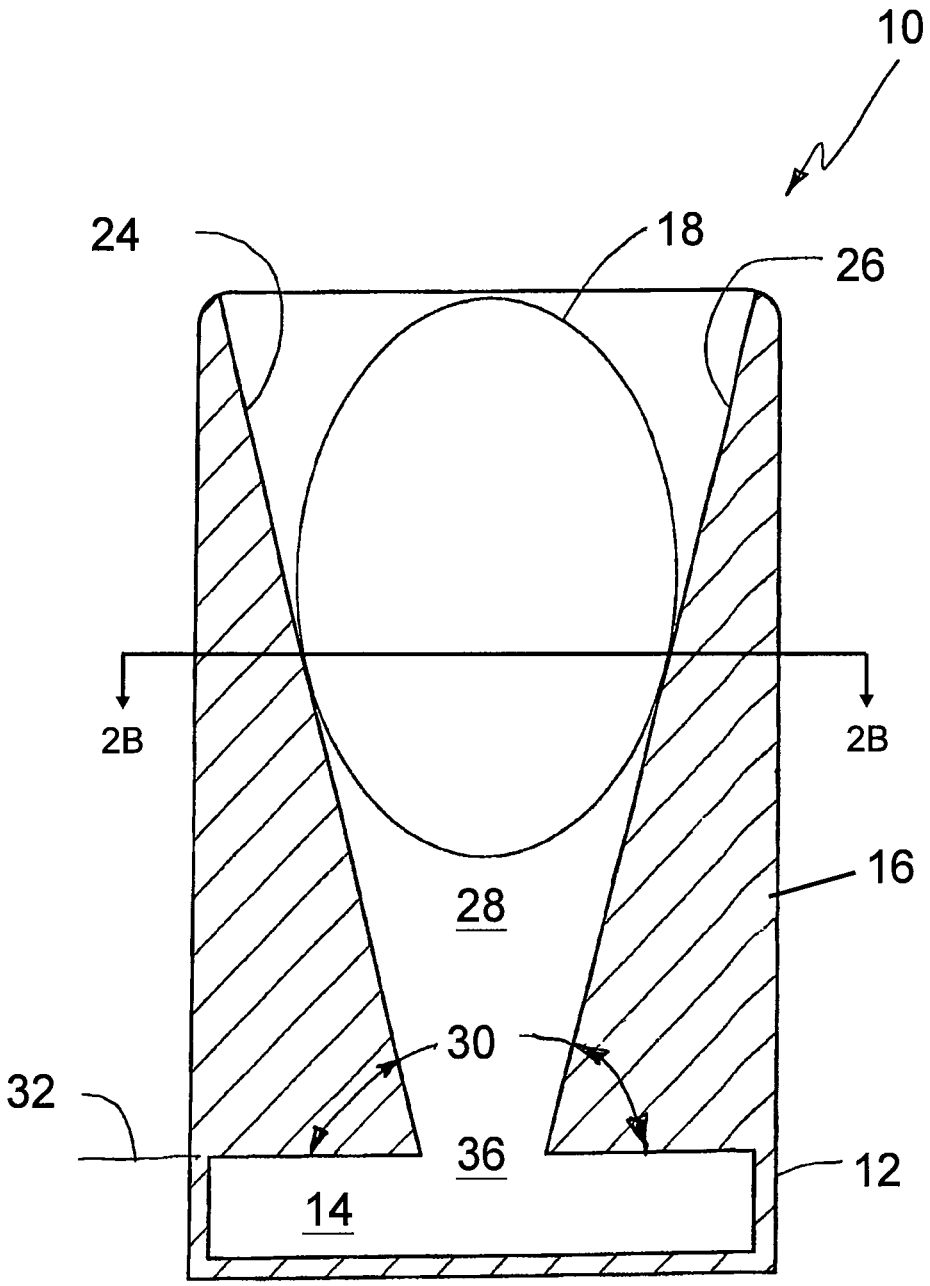
FIG. 2A schematically illustrates a plan cross sectional view of the bar soap holder of FIG. 1.

Referring to FIGS. 1 and 2, a bar soap holder 10 includes a support base 12, a reservoir 14, and a soap holder body 16. The support base 12 may be supported or anchored to provide several advantages. In one embodiment, the support base 12 provides support by shifting the center of gravity of the bar soap holder 10 lower. In one example, the support base 12 is designed with a sufficient form factor or planform to prevent the bar soap holder 10 from tipping over easily. In another example, the support base 12 is weighted. Weighting the support base provides the additional benefit of allowing a soap bar 18 to be removed without substantial movement of the bar soap holder 10, so one-handed operation is restored. The inventor's experiments have determined that a bar soap holder weighing 0.25 pounds or more provides sufficient anchoring to allow the soap bar to be dislodged from the bar soap holder 10. To this end, the support base 12 may be formed from high density plastic, metal, or include a filler (not shown) such as sand. The soap holder body 16 may be formed of plastic, metal, or other suitable material.

The reservoir 14 provides a collection point for the soapy water that runs off the bar of soap, and keeps it away from the bar soap while it is drying between uses. As explained above, in many prior art designs, the bar of soap sits in soap water between uses, allowing it to become soft and messy, which results in wasted soap and requires time and effort for frequent cleaning of the soap dish. In contrast, the reservoir 14 of the present invention is situated well below the position of the bar soap. In the disclosed embodiment, the reservoir 14 is formed within the support base 12, thus providing additional anchoring as it fills with soap water.

Although not illustrated, the reservoir 14 may further include a drain feature to make cleaning easier. For example, the support base 12 may be formed with hole in the bottom, and a removable rubber plug may be inserted into the hole to prevent the soap water from leaking onto a countertop. When cleaning or emptying is desired, the reservoir 14 contents can be emptied into a sink, the plug can be removed, and running water can be rinsed through the reservoir 14.

The soap holder body 16 may be integral with the support base 12 and reservoir 14, and in the illustrated embodiment has a rectangular form factor rising vertically from the support base 12. Of course, other stylistic form factors are envisioned without departing from the scope of the invention. The top surface 20 of the soap holder body 16 defines an upper central opening 22 dimensioned for receiving the soap bar 18. In this respect, the opening 22 may be sized relatively large to accommodate as large a number of bar soap sizes as possible. On the other hand, the opening 22 may be sized to narrow specifications in order to market the bar soap holder 10 together with a specific type or brand of soap. In the illustrated embodiment, the upper central opening 22 is formed as a cavity within the soap holder body 16, but in other embodiments such as that illustrated in FIGS. 5 and 6 the opening 22 may simply comprise the open-air environment around the top of the soap holder body 16.

One problem associated with prior art bar soap holders is that, over time, they tend to collect soap residue at the soap-holding surfaces. The soap residue may be from the soap water drying up, or left over from the soft, water-sogged portions of the bar soap. Because the soap-holding surfaces are essentially flat, the soap residue continues to build up over time, presenting an unsightly mess that is difficult to clean. As anyone who has cleaned a soap dish can attest, as cleaning water is added to the built-up soap residue, the residue breaks down into highly concentrated soapy water. Large amounts of water and repetitions are required to finally dilute the soap residue enough to wash away.

To overcome this noted problem, the inventor of the current invention has recognized the advantages of preventing the soap residue from building up in the first instance, and has thus devised a self-cleaning bar soap holder that enables the bar soap support surface to continually and automatically clean itself using the force of gravity to drain away the soap water. The soap holder body 16 includes a first support surface 24 and an opposing second support surface 26 disposed within an interior region 28 of the soap holder body 16. The support surfaces 24, 26 tandomly support the soap bar 18 and are thus positioned opposing or across from each other in a manner to accomplish the intended goal. Specifically, the first support surface 24 and the second support surface 26 are positioned at a tapered incline angle 30 relative to a horizontal plane 32 of the bar soap holder 10. The support surfaces 24, 26 may be planar or, as illustrated in FIG. 1, may form an arc in the horizontal (e.g., non-vertical) planes. In this manner, the soap bar 18 contacts the support surfaces 24, 26 partially making line contact (or surface contact) thereon. In the illustrated embodiment, the incline angle 30 is approximately 75° for each of the support surfaces 24, 26, which has proven highly effective in effectuating the self-cleaning characteristics of the each. However, experimentation and testing have demonstrated that the incline angle 30 may be significantly less than 75° and still provide the desired self-cleaning results. In fact, the inventor has concluded that an incline angle 30 as little as 25° still allows the soap water to drain off the support surfaces 24, 26. However, incline angles of less than 25° tend to be insufficient for the physical properties of the soap water to overcome the adhesion and binding forces with the support surfaces and succumb to gravity.

In some embodiments, such as when the incline angle 30 is not very steep (e.g., less than 45°), the self-cleaning characteristics of the bar soap holder 10 may be aided by the inclusion of at least one longitudinal groove 34 in the support surface to aid in draining soap water into the reservoir 14. The longitudinal groove 34 may extend the entire length of the support surface or, as shown, may extend only a portion of the length.

The soap holder body 16 further defines a drain path 36 from the first and second support surfaces 24, 26 to the reservoir 14. The drain path 36 channels the soap water coming off the first and second support surfaces 24, 26 in a controlled manner so as to prevent spilling or leakage onto a countertop, which is messy and undesirable. In the illustrated embodiment, the drain path 36 is formed in the area shared between the bottom ends of the first and second support surfaces 24, 26. The soap water flowing off the support surfaces 24, 26 drips through the drain path 36 aided by gravity and collects in the reservoir 14.

Figure 2B:
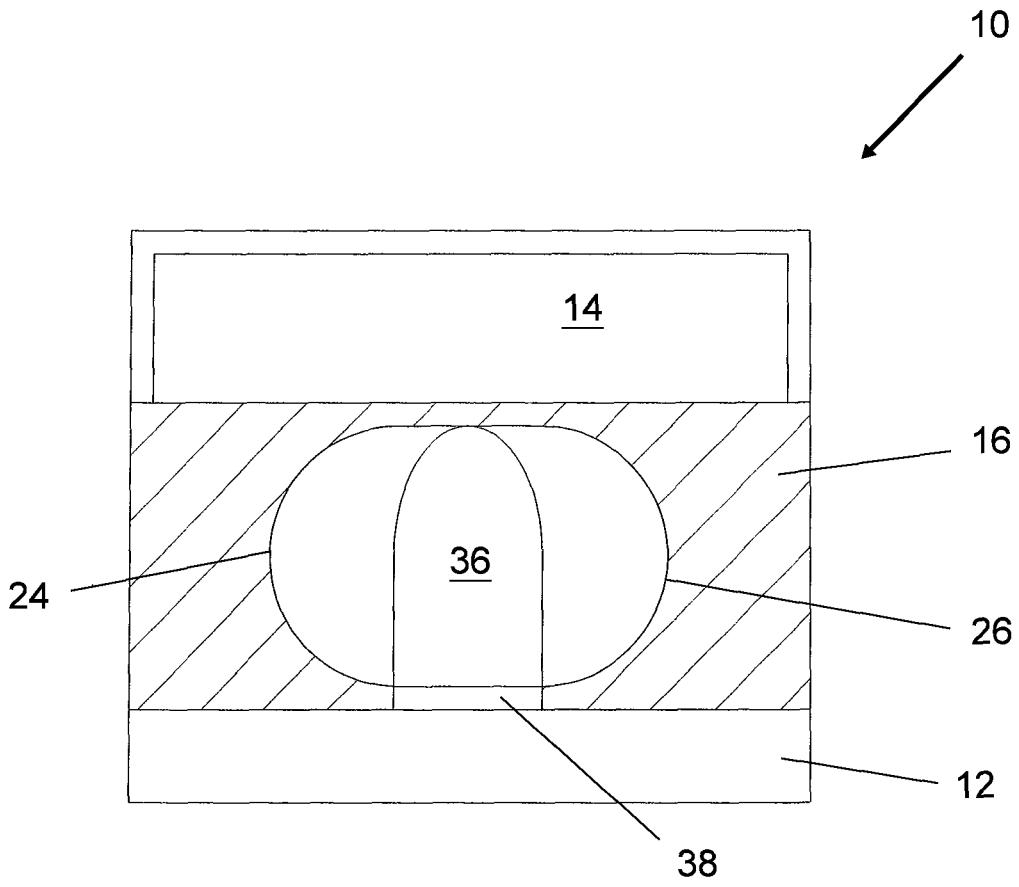
FIG. 2B schematically illustrates a top cross sectional view of the bar soap holder of FIG. 2A, taken approximately midway through the height of the bar soap holder.

As can be appreciated with respect to the illustrated embodiments disclosed herein, the soap bar 18 is conveniently held in place by the first and second support surfaces 24, 26. As the size of the bar 18 decreases with usage, it is still held in place by surfaces 24, 26 but at physically lower locations. Even as the soap bar 18 decreases to a fraction of its original size, the support surfaces 24, 26 continue to provide self-cleaning characteristics. As the soap bar 18 decreases in size, it may be beneficial to provide a means to grasp the bar, especially when it has shrunk in size such that it lays below the top surface 20 of the soap holder body 16. Referring now to FIG. 2B in addition to FIGS. 1 and 2A, the soap holder body 16 may further define a first access slot 38 extending downwardly from the upper central opening 22. The first access slot 38 is dimensioned to allow grasping the soap bar 18 to aid in removal or dislodgement from the bar soap holder 10. Thus, the first access slot 38 is preferably wider than most fingers. The first access slot 38 may include a tapered portion 40 for easier removal of the soap bar 18. In the illustrated embodiment, the tapered portion 40 is located towards the top of the soap holder body 16, and is tapered at approximately the same angle as the first support surface 24, (e.g., the incline angle 30). Also shown in FIG. 2B is the curvature or arc of the support surfaces 24, 26.

Figure 3:
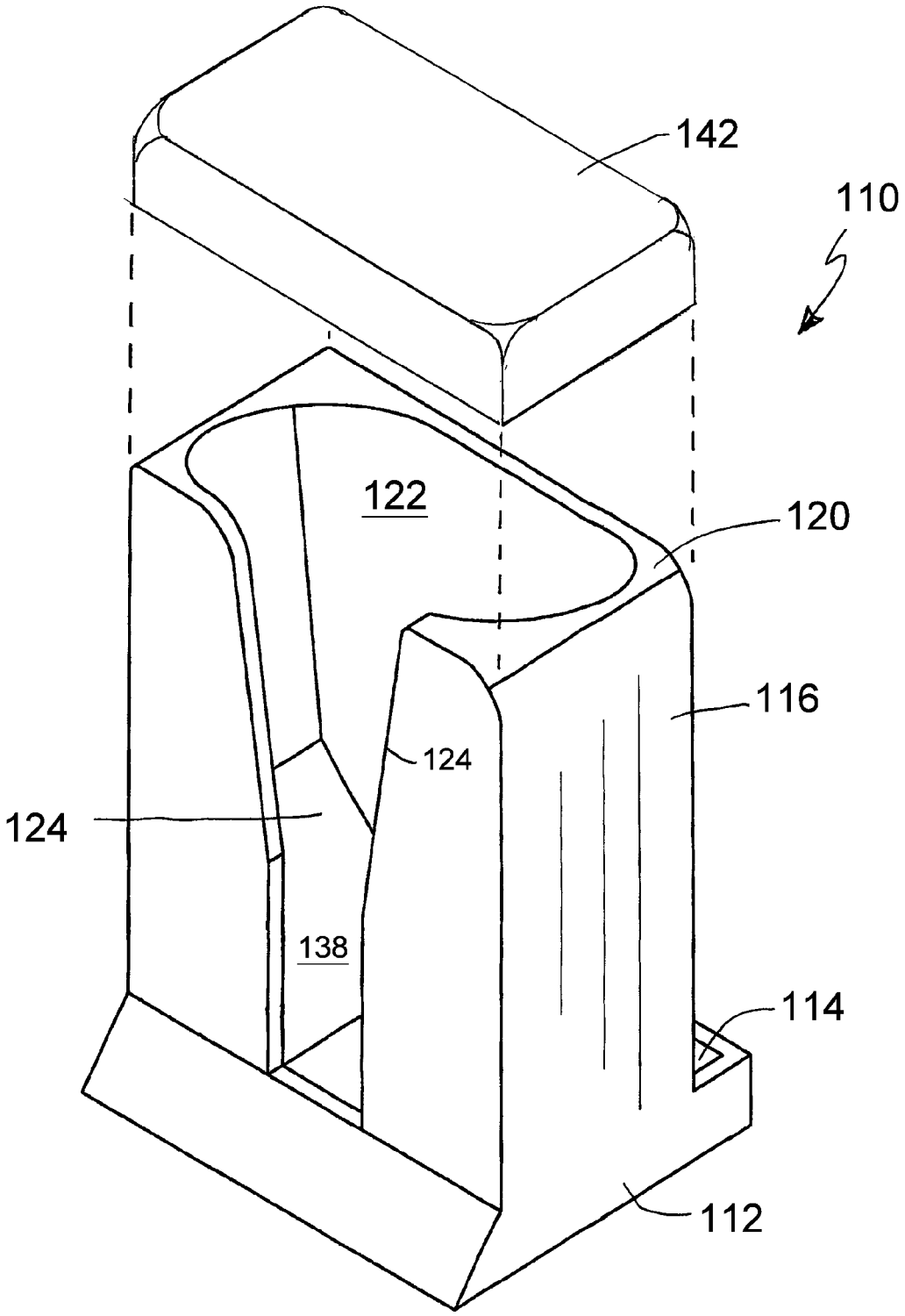
FIG. 3 schematically illustrates an exploded perspective view of a bar soap holder according to another embodiment of the invention.
Figure 4:
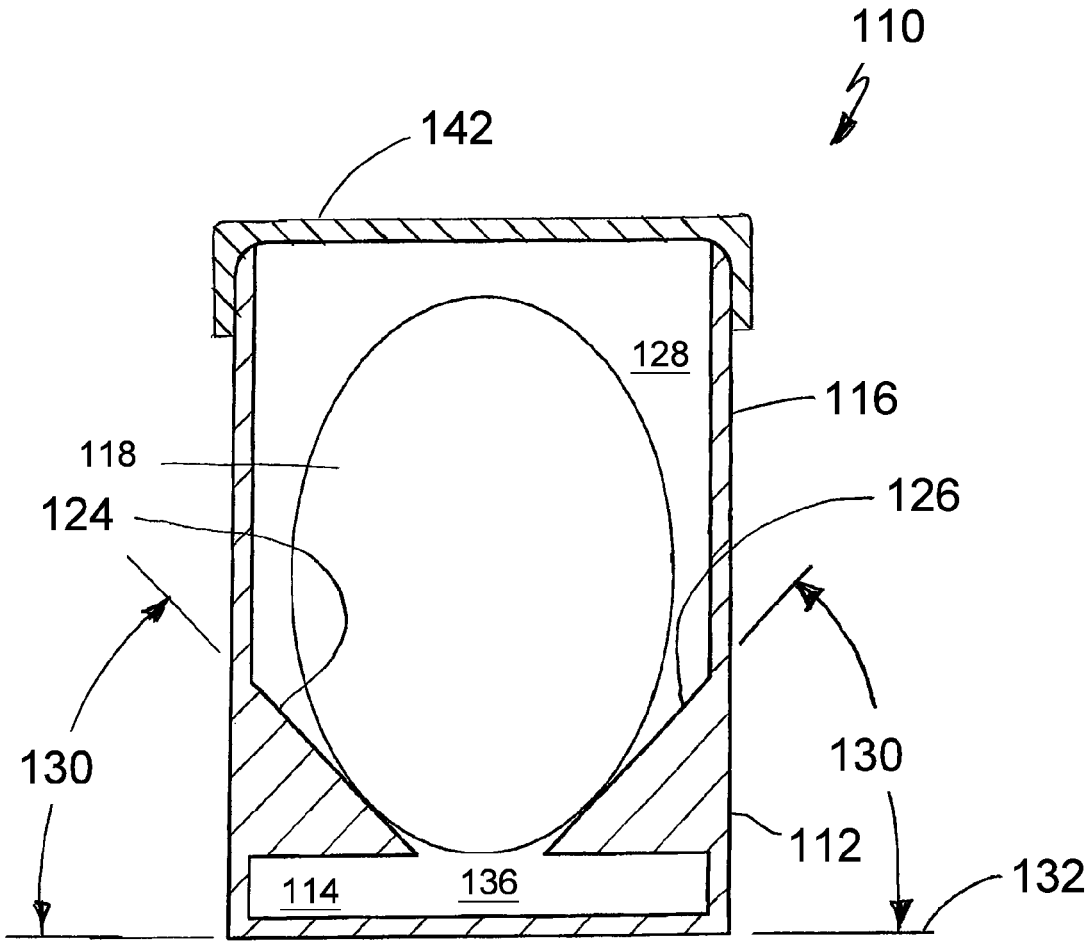
FIG. 4 schematically illustrates a cross sectional view of the bar soap holder of FIG. 3.

Referring now to FIGS. 3 and 4, a "travel pack version" of a bar soap holder 110 is shown. In one respect, the travel pack version or embodiment of the bar soap holder 110 differs from that illustrated in FIGS. 1 and 2 in that it comprises a compact form factor for easier stowage. The bar soap holder 110 includes a support base 112 to shift the center of gravity of the bar soap holder 110 lower. As shown, the support base 112 comprises a large-area planform to prevent the bar soap holder 110 from tipping over easily, thus allowing easier removal of a soap bar 118. The bar soap holder 110 further includes a reservoir 114 formed within the support base 112, which further decreases the form factor.

The bar soap holder 110 includes a soap holder body 116 integral with the support base 112. The top surface 120 of the soap holder body 116 defines an upper central opening 122 dimensioned for receiving the soap bar 118. The soap holder body 116 further includes a first support surface 124 and an opposing second support surface 126 disposed within an interior region 128 of the soap holder body 116. As described with respect to the embodiment of FIGS. 1 and 2, the support surfaces 124, 126 tandomly support the soap bar 118 and are positioned at a tapered incline angle 130 relative to a horizontal plane 132 of the bar soap holder 110. In the illustrated embodiment, the incline angle 130 is approximately 45° for each of the support surfaces 124, 126, which decreases the form factor (e.g., height) relative to the embodiment with an incline angle of 75°. However, incline angles of as little as 25° still allow the soap water to drain off the support surfaces 124, 126. In contrast to the embodiment described with respect to FIGS. 1 and 2, the support surfaces 124, 126 are positioned much lower within the interior region 128 so that the soap bar 118 does not protrude higher than top surface 120 of the soap holder body 116.

Similar to the embodiment described with respect to FIGS. 1 and 2, the soap holder body 116 defines a drain path 136 from the first and second support surfaces 124, 126 to the reservoir 114. The drain path 136 channels the soap water coming off the first and second support surfaces 124, 126 in a controlled manner so as to prevent spilling or leakage onto a countertop. In the illustrated embodiment, the drain path 136 is formed in the area shared between the bottom ends of the first and second support surfaces 124, 126. The soap water flowing off the support surfaces 124, 126 drips through the drain path 136 aided by gravity and collects in the reservoir 114. The bar soap holder 110 optionally includes a first access slot 138 extending downwardly from the upper central opening 122 to allow grasping the soap bar 118 to aid in removal or dislodgement from the bar soap holder 110.

The travel pack version of the bar soap holder 110 further includes a cover 142 to prevent the soap bar 118 from falling out of the soap holder body 116. The cover 142 may be sized to snugly fit over the soap holder body 116, and may include provisions such as detents and the like to secure the cover in place. In one embodiment (not shown), the cover 142 extends the full length of the soap holder body 116 so as to fully cover and enclose the first access slot 138.

Figure 5:
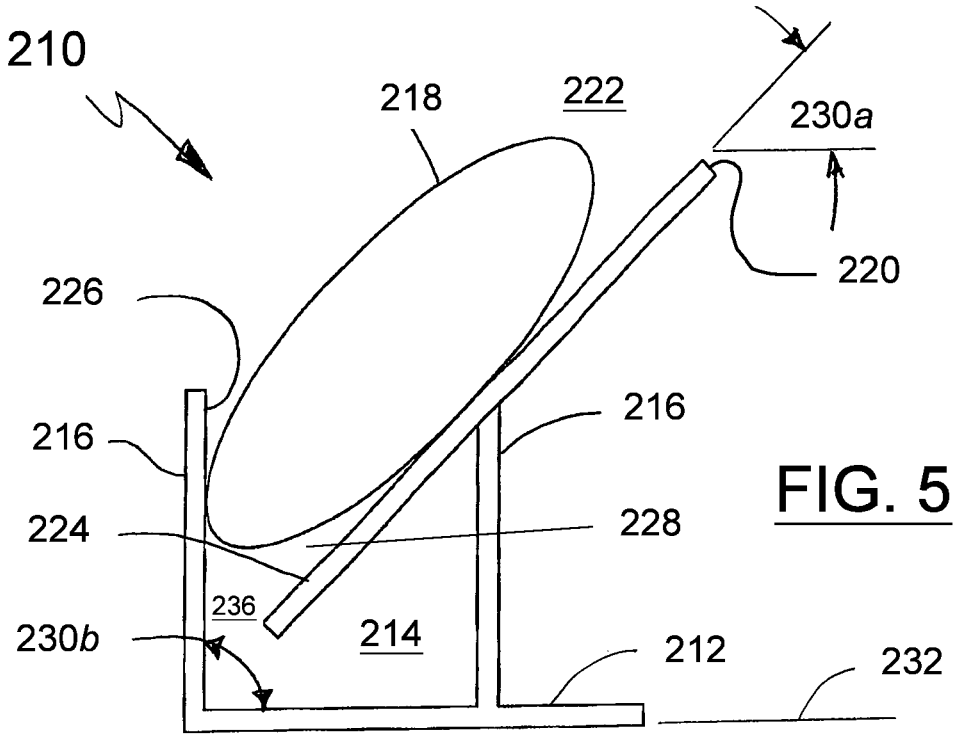
FIG. 5 schematically illustrates a cross-sectional view of a bar soap holder according to another embodiment of the invention.

Turning now to FIG. 5, another embodiment of the bar soap holder 210 is shown in cross section. The bar soap holder 210 includes a support base 212 to shift the center of gravity of the bar soap holder 210 lower. As shown, the support base 212 comprises a large-area planform to prevent the bar soap holder 210 from tipping over easily, thus allowing easier removal of a soap bar 218. The bar soap holder 210 further includes an integral reservoir 214 formed within the support base 212. The reservoir 214 is enclosed, and may be emptied or rinsed by removal of the soap bar 218.

The bar soap holder 210 includes a soap holder body 216 integral with the support base 212. As described hereinabove, the top surface 220 of the soap holder body 216 defines an upper central opening 222 that is simply the open-air environment around the top of the soap holder body 216. The soap holder body 216 further includes a first support surface 224 and an opposing second support surface 226 disposed within an interior region 228 of the soap holder body 216. As described with respect to the embodiment of FIGS. 1 and 2, the support surfaces 224, 226 tandomly support the soap bar 218 and are positioned at a tapered incline angle 230 relative to a horizontal plane 232 of the bar soap holder 210. In the illustrated embodiment, the incline angle 230*a* of the first support surface 224 is different from the incline angle 230*b* of the second support surface 226. The incline angle 230*a* of the first support surface 224 is approximately 45°, while the incline angle 230*b* of the second support surface 226 is approximately 90°, and actually comprises inner wall of the soap holder body 216.

Similar to the embodiment described with respect to FIGS. 1 and 2, the soap holder body 216 defines a drain path 236 from the first and second support surfaces 224, 226 to the reservoir 214. The drain path 236 channels the soap water coming off the first and second support surfaces 224, 226 in a controlled manner so as to prevent spilling or leakage onto a countertop. In the illustrated embodiment, the drain path 236 is formed in the area shared between the bottom ends of the first and second support surfaces 224, 226. The soap water flowing off the support surfaces 224, 226 drips through the drain path 236 aided by gravity and collects in the reservoir 214.

Figure 6:
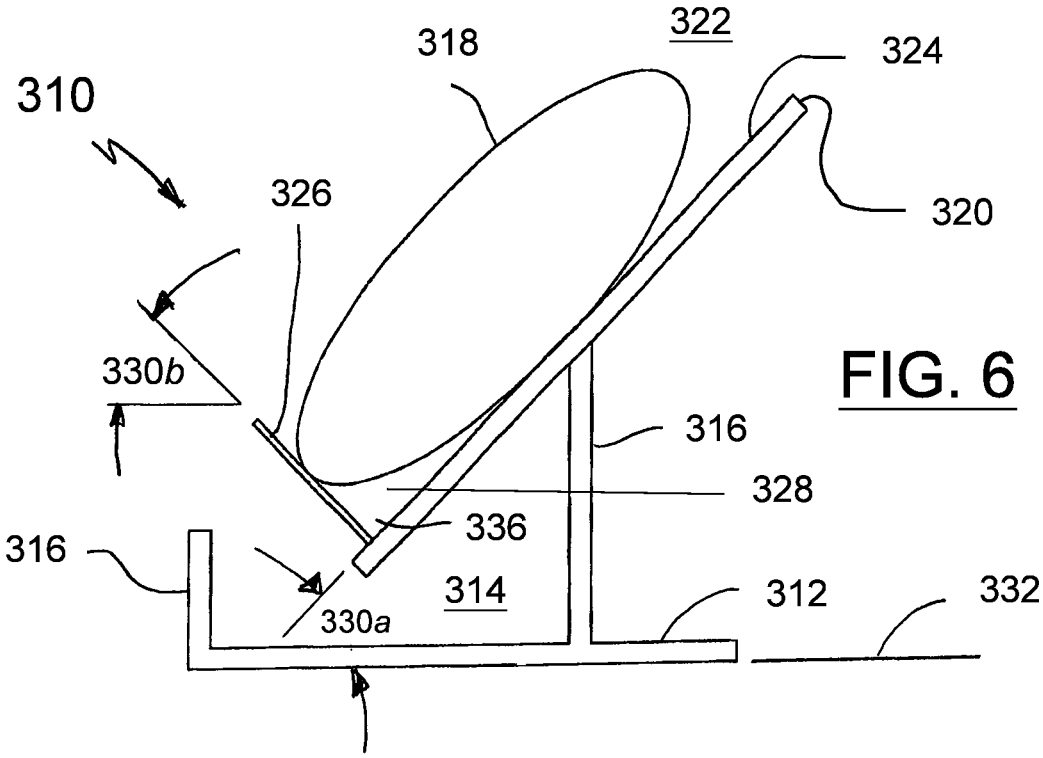
FIG. 6 schematically illustrates a cross-sectional view of a bar soap holder according to yet another embodiment of the invention.

Turning now to FIG. 6, another embodiment of the bar soap holder 310 is shown in cross section. The bar soap holder 310 includes a support base 312 to shift the center of gravity of the bar soap holder 310 lower. As shown, the support base 312 comprises a large-area planform to prevent the bar soap holder 310 from tipping over easily, thus allowing easier removal of a soap bar 318. The bar soap holder 310 further includes an integral reservoir 314 formed within the support base 312.

The bar soap holder 310 includes a soap holder body 316 integral with the support base 312. As described hereinabove, the top surface 320 of the soap holder body 316 defines an upper central opening 322 that is simply the open-air environment around the top of the soap holder body 316. The soap holder body 316 further includes a first support surface 324 and an opposing second support surface 326 disposed within an interior region 328 of the soap holder body 316. As described with respect to the embodiment of FIGS. 1 and 2, the support surfaces 324, 326 tandomly support the soap bar 318 and are positioned at a tapered incline angle 330 relative to a horizontal plane 332 of the bar soap holder 310. In the illustrated embodiment, the incline angle 330 of the first support surface 324 is substantially the same as the incline angle 330 of the second support surface 326 (e.g., approximately 45°), but the two support surfaces 324, 326 are joined at their respective ends.

The soap holder body 316 defines a drain path 336 to the reservoir 314 that is transverse to the first and second support surfaces 324, 326. That is, the drain path 336 channels the soap water coming off the first and second support surfaces 324, 326 into the V-shaped groove formed at the juncture of their respective ends and spills the soap water sideways (e.g., into and out of the plane of the drawing) into the reservoir 314.

In another embodiment similar to that shown in FIG. 6, the second support surface 326 comprises a plurality of pegs attached to the bottom of the first support surface 324. The pegs are positioned at an incline angle 330 of approximately 45°. A drain path to the reservoir 314 is formed between pegs.

Figure 7:
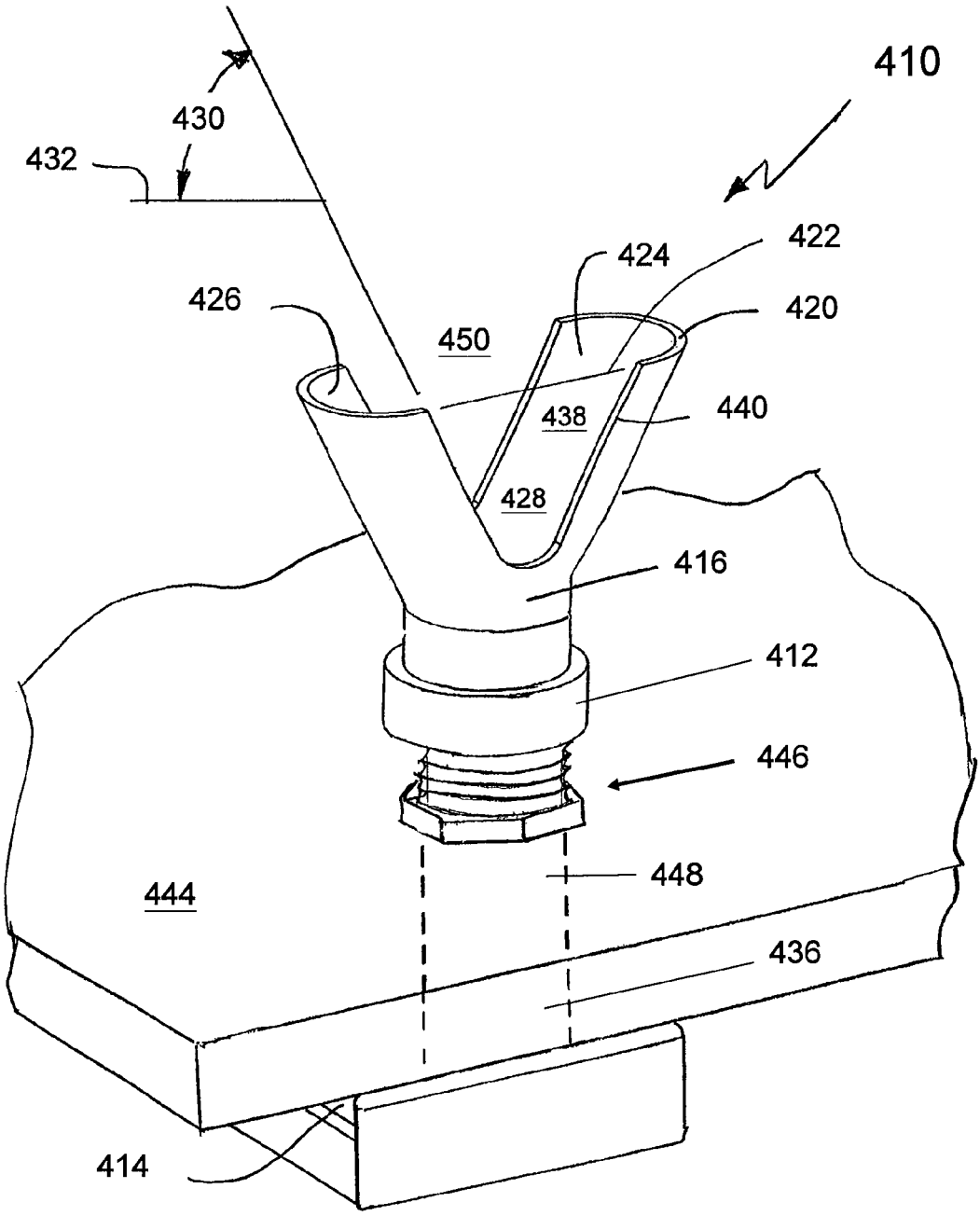
FIG. 7 schematically illustrates a perspective view of a bar soap holder according to yet another embodiment of the invention.

Turning to FIG. 7, another embodiment of the present invention is shown in which a bar soap holder 410 is adapted for permanent securement to a sink countertop 444. The bar soap holder 410 includes a support base 412 that is anchored to the countertop 444 by an attachment element 446. In one example, the attachment element 446 comprises a threaded rod and coupling nut. The threaded rod extends through an access hole 448 in the countertop 444 and the coupling nut threads onto the rod from underneath. In other examples (not shown), the support base 412 may be anchored to the countertop 444 by four bolts, or with a waterproof adhesive.

The bar soap holder 410 further includes a soap holder body 416 integral with the support base 412, and in the illustrated embodiment has a decorative V-shaped form factor. The top surface 420 of the soap holder body 416 defines an upper central opening 422 dimensioned for receiving the soap bar (not shown). The soap holder body 416 further includes a first support surface 424 and an opposing second support surface 426 disposed within an interior region 428 of the soap holder body for supporting the soap bar. The first support surface 424 and the second support surface 426 are positioned at a tapered incline angle 430 greater than 25° relative to a horizontal plane 432 formed by, for example, the countertop 444. The soap holder body 416 further defines a first access slot 438 extending downwardly from the upper central opening 422. The first access slot 438 is dimensioned to allow grasping the soap bar to aid in removal. In the illustrated embodiment, the first access slot 438 includes a tapered portion 440. In some embodiments, the soap holder body 416 may further define a second access slot 450 opposing the first access slot 438. The second access slot 450 together with the first access slot 438 allows the soap to be grasped and removed from the holder 410 more easily.

The soap holder body 416 further defines a drain path 436 (shown in phantom) extending through the support base 412 of the bar soap holder 410. In the illustrated embodiment, the drain path 436 is a hole approximately 0.5 inches in diameter, and extends through the threaded rod of the attachment element 446. The corresponding access hole 448 in the countertop 444 joins the drain path 436 to a reservoir 414 located underneath the countertop 444 to collect the soap water. Illustrated for exemplary purposes is a rectangular drawer that may be pulled out and removed from the countertop 444 for periodic cleaning. Alternatively, the reservoir 414 may be a plastic bottle with internal threads in the neck that thread to the threaded rod of the attachment element 446. In another embodiment, the drain path 436 may be plumbed to a sink drain or the like (not shown), in which case the sink trap may serve as a temporary reservoir until running water from the sink faucet flushes out the soap water in the trap. The perimeter of the drain path 436 in the support base 412 may be sealed to the countertop 444 with sealant.

Figure 8A:
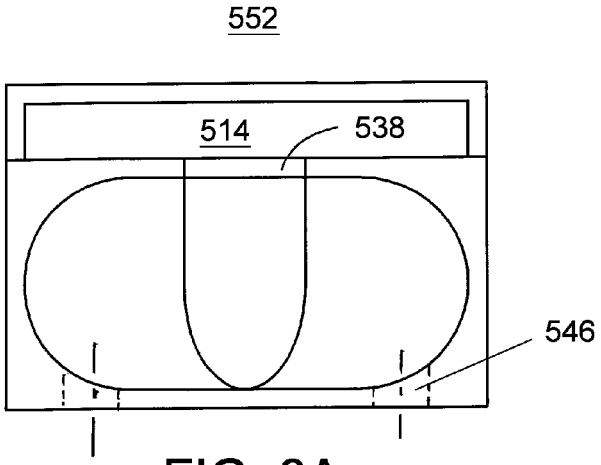
FIGS. 8A-8C schematically illustrate top, front, and side elevational views, respectively, of a bar soap holder according to an embodiment of the invention in which the bar soap holder is vertically mounted to a wall.
Figure 8A:
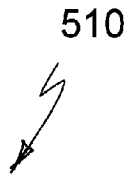
Figure 8B:
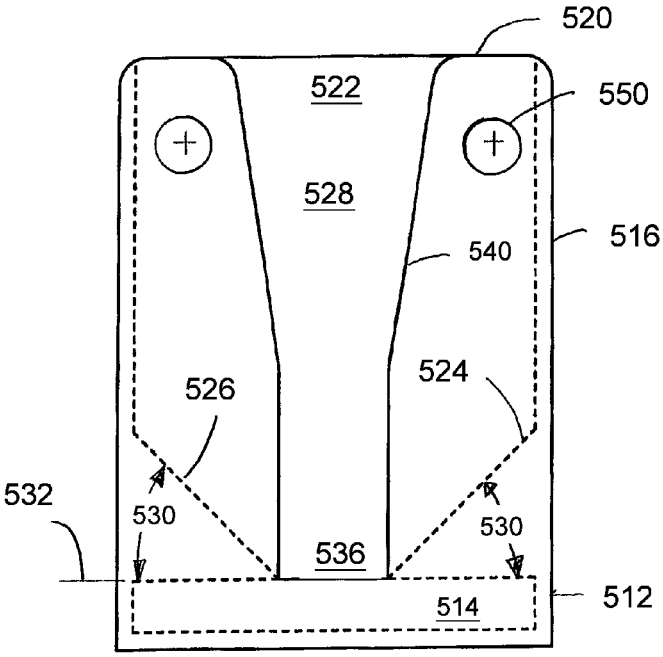
Figure 8C:
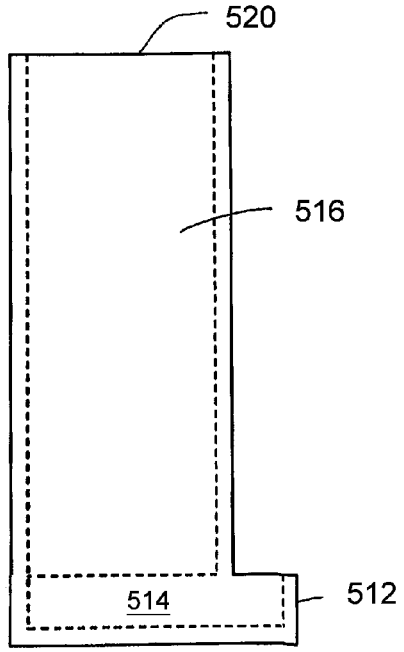

Turning to FIGS. 8A-8C, yet another embodiment of the present invention is shown adapted for vertical mounting to a fixture other than a sink, such as vertically mounted to a wall, for example. The lower portion of the bar soap holder 510 includes a reservoir 514 for collection of soap water. The reservoir 514 may protrude out from a front side 552 of the soap holder 510 as shown, or may be flush. Integral with the reservoir 514 is a soap holder body 516 which, in the illustrated embodiment, is rectangular in cross section and extends vertically a distance greater than the length of a bar of soap. The top surface 520 of the soap holder body 516 defines an upper central opening 522 dimensioned for receiving the soap bar (not shown). The upper central opening 522 is formed as a cavity within the soap holder body 516.

The soap holder body 516 includes a first support surface 524 and an opposing second support surface 526 disposed within an interior region 528 of the soap holder body 516. The support surfaces 524, 526 tandomly support the bar of soap and are thus positioned opposing or across from each other. Specifically, the first support surface 524 and the second support surface 526 are positioned at a tapered incline angle 530 relative to a horizontal plane 532 of the bar soap holder 510. In the illustrated embodiment, the incline angle 530 is approximately 45° for each of the support surfaces 524, 526, but as described with reference to the embodiments illustrated in FIGS. 1 and 2, the incline angle 530 may be as small as 25° and still provide the desired self-cleaning results.

The soap holder body 516 defines a first access slot 538 extending downwardly from the upper central opening 522 to allow grasping the soap bar to aid in removal or dislodgement from the bar soap holder 510. As illustrated, the first access slot 538 may include a tapered portion 540 for easier removal of the soap bar. The soap holder body 516 further defines a drain path 536 from the first and second support surfaces 524, 526 to the reservoir 514 to channel the soap water in a controlled fashion.

The bar soap holder 510 further includes an attachment element 546 to facilitate mounting the holder to a wall, such as a wall in proximity to a sink. In the illustrated embodiment, the attachment element 546 comprises two screws adapted for securement to a tile wall. The attachment element 546 may also comprise an adhesive.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

What is claimed is:

1. A bifurcated flared tubular bar soap holder for holding a bar of soap about vertical comprising:

a tubular support defining a portion of a drain;

a bifurcated flared tube section extending from said tubular support defining a central axis, said bifurcated flared tube section flaring in about a flared plane which includes said central axis, said bifurcated flared tube section comprising:

a bifurcated pair of tubular troughs bifurcatingly diverging from said central axis, each of said tubular troughs having an open tubular section and a pair of trough edges; and wherein said bifurcated pair of tubular troughs define a V-shaped central tubular trough opening to hold the bar of soap substantially vertically as supported by said open tubular sections of said bifurcated pair of tubular troughs;

a pair of access slots comprising:

a first access slot disposed about in a first access slot plane defined by a first trough edge of one of said bifurcated pair of tubular troughs and an opposite trough edge of another one of said bifurcated pair of tubular troughs;

a second access slot disposed about in a second access slot plane defined by a second trough edge of one of said bifurcated pair of tubular troughs and an opposite trough edge of another one of said bifurcated pair of tubular troughs;

wherein said pair of access slots provide a manual two-finger access to the bar of soap held substantially vertically by said open tubular sections of said bifurcated pair of tubular troughs; and a soap water reservoir coupled to an opposite end of said tubular support.

2. The bifurcated flared tubular bar soap holder of claim 1, wherein an inside radius of each of said tubular troughs is about equal to an inside radius of said tubular support.

3. The bifurcated flared tubular bar soap holder of claim 1, wherein each of said tubular troughs defines an incline of about 75 degrees relative to a horizontal plane perpendicular to said central axis.

4. The bifurcated flared tubular bar soap holder of claim 1, wherein said tubular support comprises threads.

5. The bifurcated flared tubular bar soap holder of claim 1, wherein a soap water converges to a lowest point on the bar of soap and drips directly into said reservoir.

* * * * *